US008246264B2

(12) United States Patent
Malvar et al.

(10) Patent No.: US 8,246,264 B2
(45) Date of Patent: Aug. 21, 2012

(54) APPLICATOR FOR TRANSPORTING, DISPENSING AND APPLYING MATERIAL

(75) Inventors: Michael Malvar, Oceanside, NY (US); Volker Schrepf, East Islip, NY (US); Caroline DeFrance, Brooklyn, NY (US)

(73) Assignee: Albea Services, Genevilliers (FR)

( * ) Notice: Subject to any disclaimer, the term of this patent is extended or adjusted under 35 U.S.C. 154(b) by 1191 days.

(21) Appl. No.: 12/070,257

(22) Filed: Feb. 14, 2008

(65) Prior Publication Data

US 2008/0205968 A1 Aug. 28, 2008

Related U.S. Application Data

(60) Provisional application No. 60/903,067, filed on Feb. 23, 2007.

(51) Int. Cl.
*A45D 40/04* (2006.01)

(52) U.S. Cl. ..... 401/68; 401/172

(58) Field of Classification Search ..... 401/138, 401/11, 175, 55, 64, 68, 69, 70, 75, 172, 401/174, 83, 84, 110, 112, 82; 132/74.5, 132/297, 317, 318

See application file for complete search history.

(56) References Cited

U.S. PATENT DOCUMENTS 4,139,127 A * 2/1979 Gentile ..... 222/390
2009/0020551 A1 1/2009 Malvar et al.

* cited by examiner

*Primary Examiner* — Dinh Q Nguyen
*Assistant Examiner* — Viet Le
(74) *Attorney, Agent, or Firm* — Cooper & Dunham LLP

(57) ABSTRACT

A cosmetic applicator for transporting and applying cosmetic material, including a rotating applicator tip which, when rotated, dispenses cosmetic material onto the tip such that the user does not need to periodically dip the applicator tip into a reservoir of cosmetic material.

10 Claims, 5 Drawing Sheets

APPLICATOR FOR TRANSPORTING, DISPENSING AND APPLYING MATERIAL

CROSS-REFERENCE TO RELATED APPLICATIONS

This application claims the benefit of U.S. Provisional Application No. 60/903,067 filed Feb. 23, 2007, hereby incorporated by reference.

BACKGROUND OF THE INVENTION

This invention relates to a cosmetic applicator and dispenser having a rotating applicator head or tip constituted of a core having a surface for carrying cosmetic material and for applying the cosmetic material which is delivered from the dispenser.

For purposes of illustration, but without limitation, the invention will be particularly described with reference to applicators for lip gloss.

A typical applicator contains an elongated core with a multiplicity of fibers attached to the core such that the fibers extend outwardly therefrom to form a brush fiber array surrounding the core over a substantial portion of the length of the core. This combination of a core and array of fibers attached to the core provides a simple, low-cost and effective brush for the application of cosmetic materials.

Such applicators are well known and widely used in the cosmetics industry. Commonly, the proximal end of the brush is mounted in a receptacle in a threaded cap of a cosmetic material container, so that the brush projects into the container when the cap is in container-closing position. Upon removal of the cap, the brush carries a quantity of cosmetic material, such as lip gloss, out of the container, and is manipulated to deliver and apply the product to the user's body, for example the user's lips, the cap serving as a handle for the brush. Since the brush only carries a limited amount of the cosmetic material upon removal from the container, such brushes must be repeatedly dipped into the container during the application of cosmetic material to refill the brush with a sufficient amount of the cosmetic material. Thus the user must stop applying the cosmetic material to resupply the applicator with more cosmetic material as the cosmetic material on the brush is depleted.

Also, because existing applicators are fixed with respect to the handle, the majority of the cosmetic material contained on the surface is applied onto a small concentrated region of the user's body, and is subsequently moved around and spread out by the tip. Because of this, even distribution of cosmetic material can be difficult to obtain. Since ease of use and effective distribution of cosmetic material is important, a cosmetic brush desirably would apply even amounts of the cosmetic material to the user's body without using excess cosmetic material.

SUMMARY OF THE INVENTION

An object of the present invention is to provide applicators for applying cosmetic material such as lip gloss that automatically transport and dispense an appropriate amount of cosmetic material as the applicator is used. In this manner, the user will not need to repeatedly dip the applicator into the cosmetic material container during the application process.

Another object of the present invention is to provide a new type of lip gloss applicator that evenly distributes lip gloss to a wide region of the user's body without using excess cosmetic material.

To these and other ends, the present invention broadly contemplates the provision of a cosmetic brush having a core and an array of fibers projecting outwardly therefrom. In one embodiment, the fibers can be flocked to the core, for example by electrostatic delivery of fibers to an adhesive coating located on the core. However, other methods of attaching fibers may also be used. The core has holes which allow cosmetic material contained inside the core to flow to the outside surface. The core is rotatably fixed to the handle in such a manner that rotating the core against the user's body will cause additional cosmetic material to flow from the dispenser within the applicator through the core and onto the fibers, thereby ensuring that a proper amount of cosmetic material is located on the applicator tip and thus alleviating the need to repeatedly supply the applicator with cosmetic material by dipping the brush into the cosmetic material storage container or receptacle.

While the present invention will generally be described with a core having an array of fibers or flocked fibers, other surfaces can be employed to provide a surface that can both carry the cosmetic material and allow the carried cosmetic material to be applied by the user from the surface. Examples of such surfaces include the bare surface of the core formed with or modified to have indentations. The indentations can be dimples, grooves, etchings, and so forth. Other suitable surfaces can be applied as a layer or layers on the bare surface of the core, for example, foam, spongy materials and other 'soft-touch' materials. These applied surfaces can be layered onto the core by any of several methods including spray-coating, dipping, or over-molding.

The rotating design of the applicator of the present invention distributes cosmetic material evenly across a wide area by transporting the cosmetic material directly from the brush to the user's body, instead of applying a large amount of material to a small area and subsequently moving the material to other locations on the body with the brush fibers. In this way, a more even and efficient distribution of cosmetic material is provided. Accordingly, the applicators of the present invention offer the consumer the quick and easy application that the user demands, without requiring special skill or newly-learned technique for the user. Finally, the unique advancing mechanism to transport and dispense the cosmetic material ensures that a proper amount of cosmetic material is present on the applicator tip.

DETAILED DESCRIPTION OF THE PREFERRED EMBODIMENT

Figure 1:
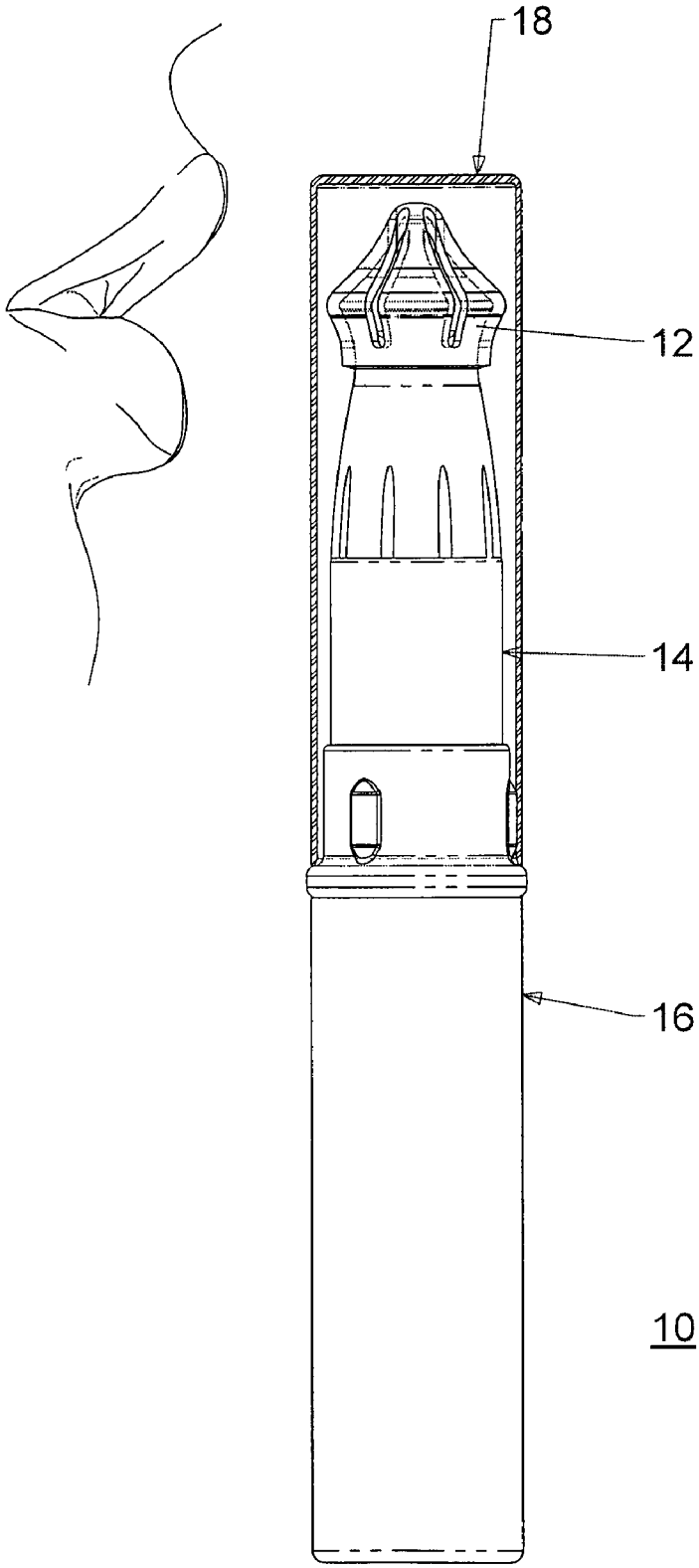
FIG. 1 is a side view of the cosmetic applicator embodying the present invention in a particular form with a protective cap.
Figure 2A:
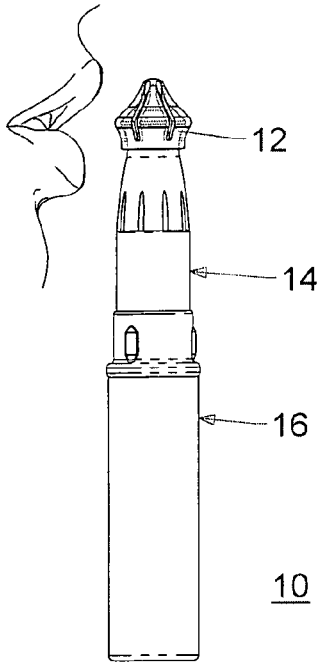
FIG. 2A is a side view of the cosmetic applicator embodying the present invention in a particular form showing an applicator tip having a concave cone shape.
Figure 2B:
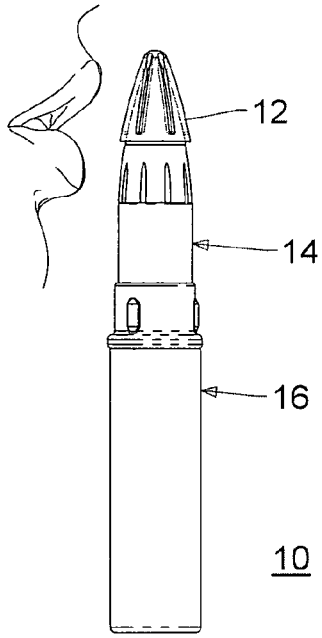
FIG. 2B is a side view of the cosmetic applicator embodying the present invention in a particular form showing an applicator tip having a convex cone shape.
Figure 2C:
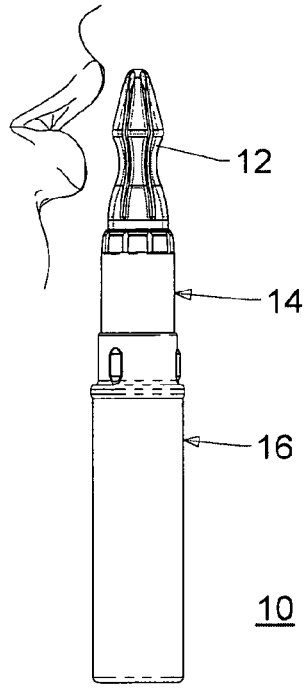
FIG. 2C is a side view of the cosmetic applicator embodying the present invention in a particular form showing an applicator tip having an hour-glass shape.
Figure 2D:
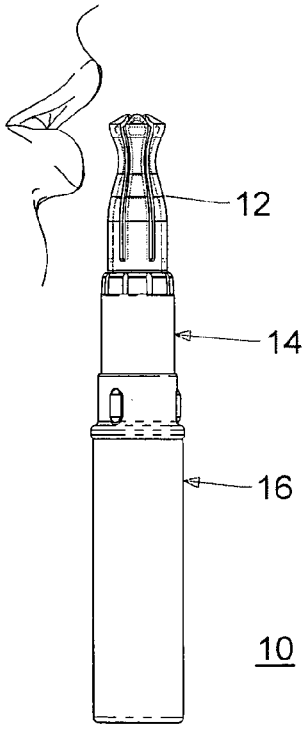
FIG. 2D is a side view of the cosmetic applicator embodying the present invention in a particular form showing an applicator tip having a blunt hour glass shape.
Figure 2E:
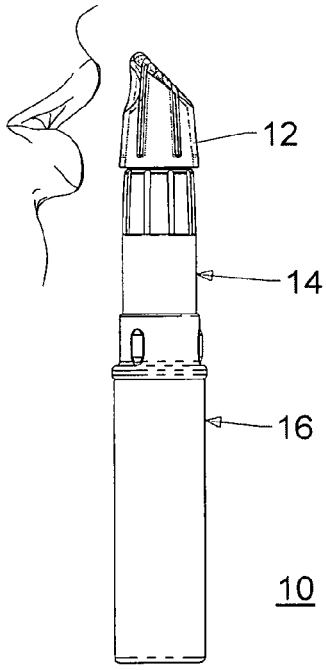
FIG. 2E is a side view of the cosmetic applicator embodying the present invention in a particular form showing an applicator tip having a non-symmetric shape.
Figure 2F:
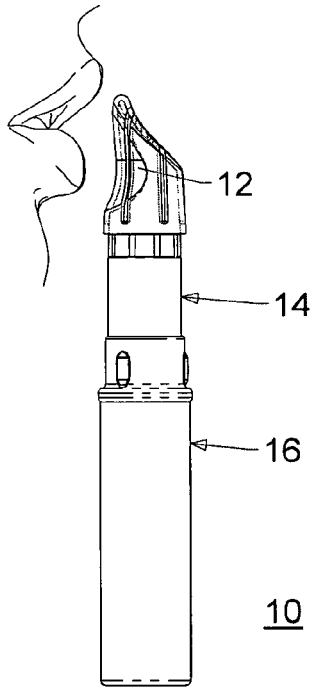
FIG. 2F the cosmetic applicator embodying the present invention in a particular form showing an applicator tip having a non-symmetric shape.

Referring to FIG. 1, one embodiment of the invention provides a lip gloss applicator 10 comprising a tip 12 rotatably connected to a cosmetic material receptacle 14, which can be constituted of plastic, metal or other suitable material. The tip 12 is connected to handle 16. Unlike conventional lip gloss applicators, in which the tip 12 is stored within the cosmetic material receptacle, the tip 12 of the present invention is rotatably connected to the top of the cosmetic material receptacle 14. To prevent the tip 12 from contamination, the tip can be inserted into a protective cap 18. The protective cap 18 covers the tip 12 and preferably attaches to handle 16 so that the tip 12 and cosmetic material receptacle 14 do not rotate when the protective cap is in place.

In accordance with other embodiments of the present invention and as shown in FIGS. 2A-2F, the tip 12 may have numerous other shapes depending on the type and quantity of cosmetic material that is to be dispensed, and/or the method of application.

Unlike conventional lip gloss applicators, the tip 12 of the present invention is not coated with cosmetic material by dipping the top into a container full of the appropriate cosmetic material. Instead, cosmetic material is stored inside of cosmetic material receptacle 14, is forced upwards through the hollow interior 20 of tip 12, and flows to the outside surface 22 of the tip. One or more holes or slits 24 connect the hollow interior 20 of the tip 12 to the outside surface 22. This configuration continuously supplies the outside surface 22 of the tip 12 with cosmetic material and eliminates the need to repeatedly dip the tip into a cosmetic material receptacle during the application of cosmetic material to a user's body.

As the tip 12 moves across a user's body, the tip rotates freely instead of remaining fixed, as is typical of traditional cosmetic material applicators. This rotational motion or energy is tapped to dispense the cosmetic material by an advancing mechanism 26 which forces the cosmetic material upward in the cosmetic material receptacle 14, through the holes 24, and onto the outside surface 22 of the applicator tip 12.

The advancing mechanism 26 has several parts. The tip 12 is rigidly attached to a hollow rotating pin 28 on the end adjacent to the cosmetic material receptacle 14. This rotating pin 28 has an inner and an outer set of ratchet (sawtooth) teeth 30, 32. Each tooth has a substantially vertical side 50 and a slanted side 52. The inner teeth 30 and the outer teeth 32 are oriented in opposite directions to each other. The cosmetic material receptacle 14 has an inner wheel 34 and an outer barrel 36 which like the pin 28 have respective sides of teeth facing in opposite directions. The teeth 31 located on inner wheel 34 are oriented in the opposite direction of, and engage, inner teeth 30 of the pin 28, while the teeth 33 on the outer barrel 36 face in the opposite direction of, and engage, outer teeth 32 of the pin 28. The inner wheel 34 extends down towards the handle 16 and has threads 38 that engage threads on a plunger nut 40 so that the plunger nut, if prevented from rotating, will travel up the threads 38 in the receptacle 14 towards the tip 12 when the inner wheel 34 and, thus, the threads 38 of the inner wheel are rotated clockwise. Outer barrel 36 has alignment ribs 42 which engage alignment slots 44 of the plunger nut 40 so that the plunger nut will rotate simultaneously with the outer barrel. Thus, when the outer barrel 36 is rotated counter-clockwise, the plunger nut 40 will travel upwards along the threads 38 towards the tip 12, provided that the inner wheel 34 and its threads 38 remain stationary. A switching spring (not shown) located toward the bottom end, that is the end opposite of tip 12, of the cosmetic material receptacle 14 independently pushes both the inner wheel 34 and the outer barrel 36 against the rotating pin 28.

More specifically, in operation, when the user rotates the tip 12 clockwise, as seen from the top, the inner teeth 30 of the pin 28 engage the teeth 31 of the inner wheel 34, that is, the vertical side 50 of the teeth abut each other, causing the wheel 34 to rotate in the same clockwise direction. As the wheel 34 rotates, the threads 38 which are attached to the wheel 34 rotate clockwise causing the plunger nut 40 to rise since the threads 38 screw through the plunger nut 40 which is rotationally immobilized by the alignment ribs 42. Also, in the clockwise direction, the outer teeth 32 of the pin 28 will not engage the teeth 33 of the outer barrel 36, but instead the slanted sides 52 of the teeth 32, 33 will slide over each other. The outer barrel 36 will thus not rotate when the tip 12 moves clockwise.

When the user rotates the tip 12 in the counter-clockwise direction, as seen from the top, the outer teeth 32 of the pin 28 engage the teeth 33 of the outer barrel 36, such that the vertical sides 50 of the teeth 32, 33 abut each other which causes the outer barrel 36 to rotate in the same counter-clockwise direction. As the outer barrel 36 rotates, the alignment ribs 42 interact with alignment slots 44 to rotate the plunger nut 40 counter-clockwise, causing the plunger nut 40 to rise since the threads 38, which screw through the plunger nut 40, are immobilized. In the counter-clockwise direction, the inner teeth 30 of the pin 28 will not engage the teeth 31 of the wheel 34, but instead the slanted sides 52 of the teeth 30, 31 will slide over each other. Thus, the wheel 34 and its threads 38 of the wheel will not rotate when the tip 12 is moved counter-clockwise.

Thus, as explained above, no matter which way the tip 12 is rotated, plunger nut 40 will rise towards the tip 12. By storing the cosmetic material above the plunger nut 40, the rotation of the tip 12 will cause the plunger nut to rise, which will in turn push the cosmetic material up into the interior 20 of the tip, through holes 24 and onto the outer surface 22 of the tip 12. In this manner, a supply of cosmetic material is transported to and dispensed to the tip 12 as the cosmetic material is applied by its tip, that is, simply by running the tip across the user's body.

Although the inner wheel 34 is described as turning only in a clockwise direction while the outer barrel 36 turns in a counter-clockwise direction, one should understand that these components can turn in either direction, so long as the teeth 30, 31, 32, 33 permit the plunger nut 40 to only move toward the tip.

Different rotating tips 12 can be provided for different user applications. For example, the embodiments of FIGS. 2A-2D are generally symmetrical about the longitudinal axis. Because of this symmetry, each portion of the tip 12 which touches the application area has the same or similar surface shape as the tip 12 rotates through 360 degrees. Accordingly, no particular circumferential portion of the tip 12 will be preferred by the user.

However, when a tip 12 is not symmetrical about the longitudinal axis, a selected circumferential portion can be preferred. For example, the embodiments shown in FIGS. 2E and 2F have an indentation along only a circumferential portion of the tip 12. Accordingly, when a user's lip is placed in the indentation and the tip 12 is rotated to apply material, the user will feel a change in the surface shape as the tip rotates to the edge of the indentation. The user will then tend to rotate the tip 12 in the opposite direction until the other end of the indentation is reached where the user will likely reverse the rotation again to cause a back and forth or 'rocking' movement across an application area. Such a non-symmetrical tip 12 is particularly useful for localized or 'spot' applications in comparison to the symmetrical tips which are useful for broader applications across a larger distance such as, for example, along an entire lip length. However, in either case, the plunger nut 40 will be pushed upward when the tip is rotated even if the rotation is back and forth.

Figure 5:
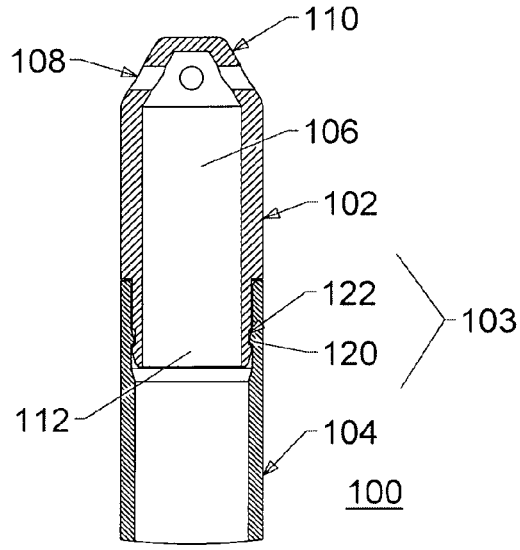
FIG. 5 is a cross-sectional view of a cosmetic applicator embodying the present invention in a particular form showing an independent rotation mechanism.
Figure 6:
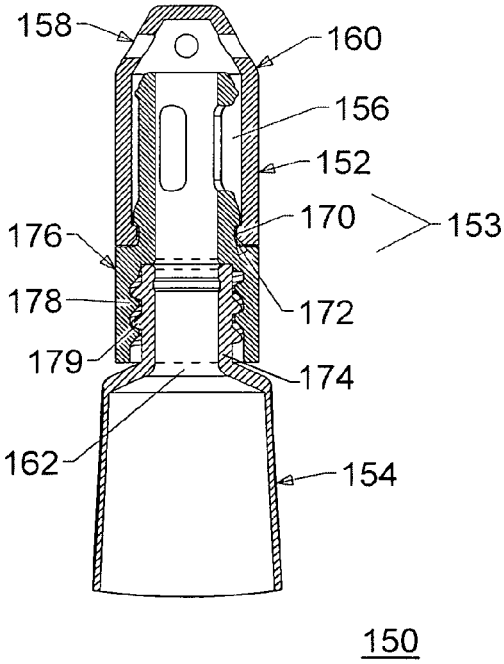
FIG. 6 is a cross-sectional view of a cosmetic applicator embodying the present invention in a particular form showing a 'screw-on' independent rotation mechanism.

In another embodiment, the advancing mechanism is independent of the rotating mechanism. As shown in FIGS. 5 and 6, the applicator 100, 150 has a tip 102, 152 and a rotatable connection 103, 153 to a receptacle 104, 154 containing the material. The receptacle 104, 154 can be incorporated in or attached to a handle. The tip 102, 152 has a hollow interior 106, 156 and one or more holes or slits 108, 158 which connect the hollow interior to the outside surface 110, 160 of the tip. The rotatable connection 103, 153 provides a passage 112, 162 which allows cosmetic material to flow from the receptacle 104, 154 into the hollow interior 106, 156 of the tip 102, 152.

In the embodiment shown in FIG. 5, the rotatable connection 103 includes one or more protrusions 120 on the receptacle 104 which travel in a groove 122 formed on the end of the tip 102.

In the embodiment shown in FIG. 6, the protrusions 170 are formed on the tip 152 for traveling in a groove 172 which can be formed on an adapter 176 attached to the receptacle 154. The 'screw-on' adapter 176 in FIG. 6 includes screw-type threads 178 for engagement with the screw-type threads 179 on a neck 174 of the receptacle 154.

Figure 7:
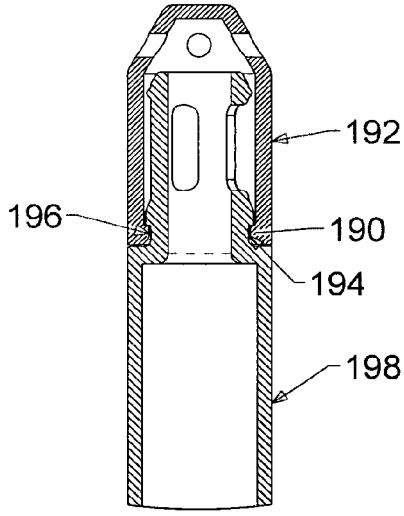
FIG. 7 is a cross-sectional view of a cosmetic applicator embodying the present invention in a particular form showing a 'snap-on' independent rotation mechanism.

The embodiment shown in FIG. 7 is similar to the embodiment shown in FIG. 6 except that an adapter is not required. Instead, the protrusions 190 are formed on the tip 192 for traveling in a groove 194 which can be formed as, or in, a neck 196 of the receptacle 198. In this embodiment, the tip 192 can be made to be sufficiently flexible so as to allow the protrusions 190 to be snapped into the groove 194.

In any of these embodiments, as the user rotates the tip 102, 152, 192 by rolling the tip across a surface, for example, the user's lips, the protrusions 120, 170, 190 will move around the groove 122, 172, 194 thereby causing the tip to rotate relative to the receptacle 104, 154, 198.

Figure 3:
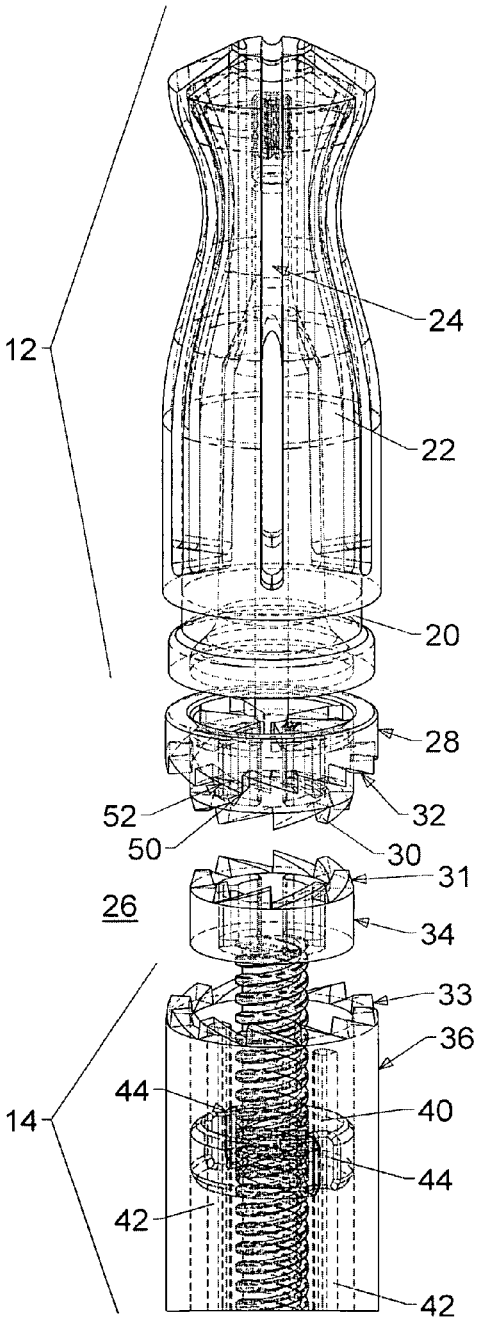
FIG. 3 is a side view of the cosmetic applicator embodying the present invention in a particular form showing the advancing mechanism.
Figure 4:
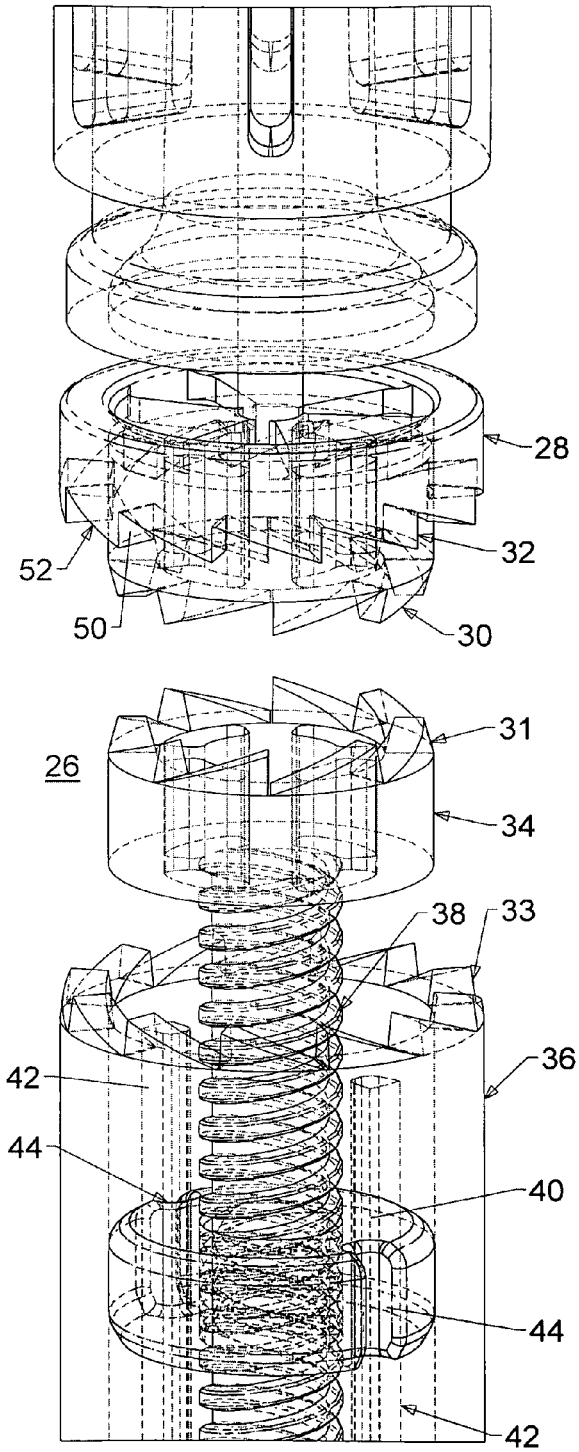
FIG. 4 is an enlarged view of the advancing mechanism of FIG. 3.
Figure 8:
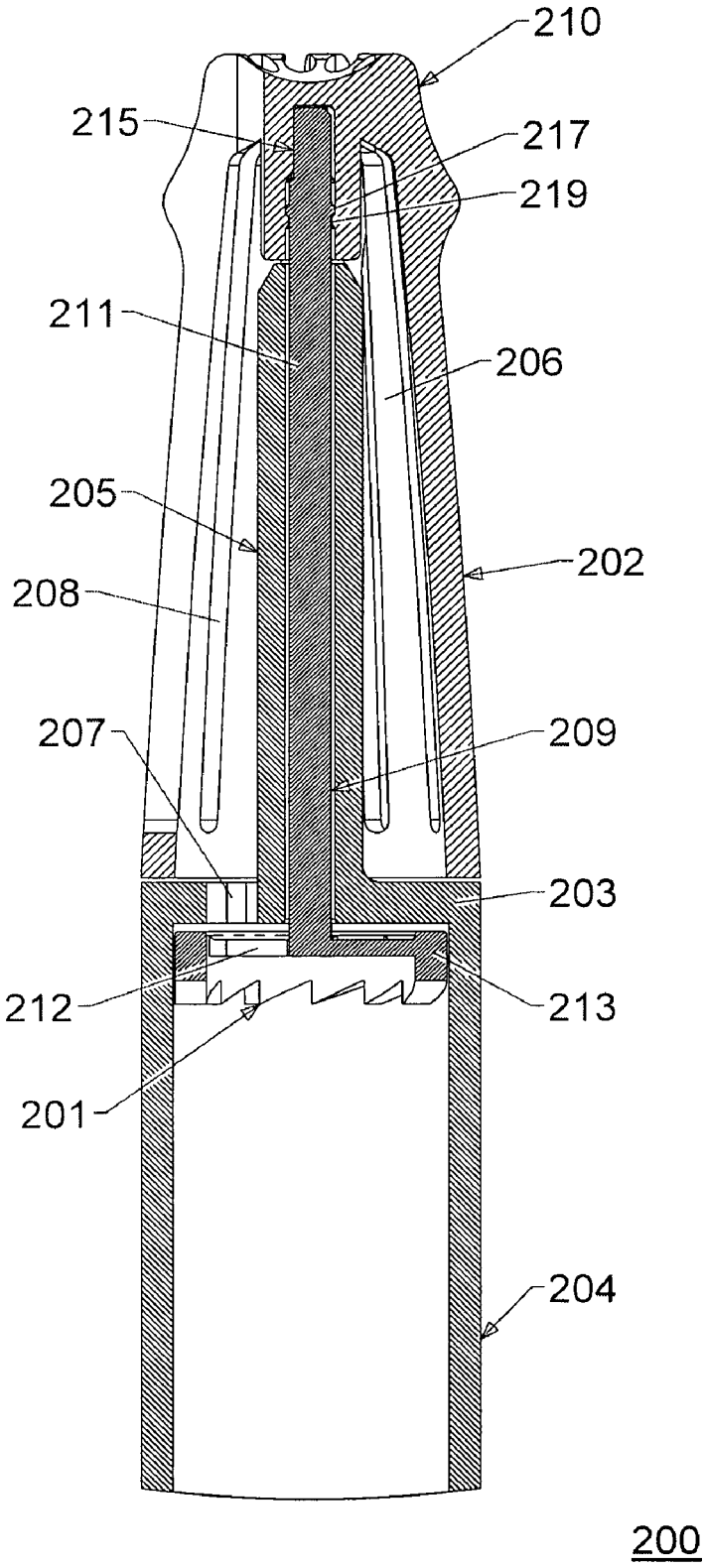
FIG. 8 is a cross-sectional view of a cosmetic applicator embodying the present invention in a particular form showing the connection between a tip and an advancing mechanism.

The applicator 200 shown in FIG. 8 illustrates how a tip 202 connects to the advancing mechanism 201 in the receptacle 204 according to one embodiment. In this embodiment, the receptacle 204 has an end wall 203 formed with, or attached to, a sleeve 205. The end wall 203 also has an opening 207. The sleeve 205 receives a connector 209 which has shaft 211 at one end and a wheel driver 213 at the other end. The tip 202 is formed with a recess 215 which faces opposite the distal end of the sleeve 205 when assembled. As in the other embodiments, the tip 202 has a hollow interior 206 and one or more holes or slits 208 which connect the hollow interior to the outside surface 210 of the tip 202. When the applicator 200 is assembled, the shaft 211 of the connector 209 extends completely through the sleeve 205 such that the exposed end of the shaft attaches to the recess 215 of the tip 202, and the wheel driver 213 is positioned within the receptacle 204 and attaches to a wheel of the advancing mechanism 201. In the embodiment shown in FIG. 8, the attachments between the shaft 211 and the recess 215 and between the wheel driver 213 and the advancing mechanism 201 can be a 'snap fit' of a ring 217 formed on the shaft over a ring 219 formed in the recess, although other attaching mechanisms can be used, for example, glue. These attachments fixedly connect the tip 202 to the connector 209 at one end and fixedly connect a wheel of the advancing mechanism 201 to the connector 209 at the other end. In this way, as the tip 202 rotates so does the connector 209 and the wheel. Since as shown in FIGS. 3 and 4, the wheel 28 will cause the plunger nut 40 to rise independent of the direction of rotation, the cosmetic material also will be pushed up. As shown in FIG. 8, this pushed-up cosmetic material will then flow through one or more holes 212 in the wheel driver 213, and through one or more openings 207 in the end wall 203 into the hollow interior 206 of the tip 202 and then out through the holes or slits 208 onto the outside surface 210 for application by the user.

In embodiments having an independent rotating mechanism, advancement of material from the receptacle into the hollow interior and then through the holes or slits onto the outer surface of the tip is not provided by the rotation of the tip, but instead is provided by activation of a separate pump. Almost any pump which moves material manually or automatically can be employed with these embodiments. Examples of such pumps include a squeeze tube receptacle, a receptacle having a rotatable threaded nut in the receptacle, a syringe plunger, and a spring loaded pump. Co-pending U.S. Application No. 60/854,494, which is incorporated herein by this reference, shows these and other such pumps.

It is to be understood that the invention is not limited to the features and embodiments hereinabove specifically set forth, but may be carried out in other ways without departure from its spirit.

What is claimed is:

1. A device for applying material to a surface comprising:

a tip having an interior space, an outer surface, and a passage between the interior space and the outer surface which allows the material to move from the interior space onto the outer surface;

a receptacle having an interior space for storing the material; and a connection between the tip and the receptacle which allows the tip to rotate with respect to the receptacle and which allows the material from the interior space of the receptacle to move into the interior space of the tip, wherein the connection comprises:

a first set of teeth and a second set of teeth at one end of the tip;

a set of teeth at one end of the receptacle engagable by the first set of teeth; and a set of teeth on a moveable platform positioned within the receptacle engagable by the second set of teeth.

2. A device as in claim 1 wherein:

the first set of teeth of the tip form an outer circle;

the second set of teeth of the tip form an inner circle within the outer circle;

the set of teeth at one end of the receptacle form a circle; and the moveable platform forms a wheel having the set of teeth formed in a circle.

3. A device as in claim 2 wherein the device further comprises:

an elongated portion of the wheel extending into the receptacle, the elongated portion having threads;

a plunger nut positioned in the receptacle having threads for engaging the threads of the elongated portion and an alignment slot; and the receptacle having at least one alignment rib for engaging the alignment slot of the plunger nut.

4. A device as in claim 1 wherein:

each tooth of the first set of teeth has a slanted side and a substantially vertical side; and each tooth of the second set of teeth has a slanted side and a substantially vertical side, such that each side of each tooth of the first set of teeth faces in the opposite direction of the corresponding side of each tooth of the second set of teeth.

5. A device as in claim 4 wherein:

each tooth of the set of teeth of the receptacle has a slanted side and a substantially vertical side; and each tooth of the set of teeth of the moveable platform has a slanted side and a substantially vertical side, such that each side of each tooth of the set of teeth of the receptacle faces in the opposite direction of the corresponding side of each tooth of the first set of teeth and each side of each tooth of the set of teeth of the moveable platform faces in the opposite direction of the corresponding side of each tooth of the second set of teeth.

6. A method of causing material to be dispensed from a tip of an applicator device according to claim 1 having a receptacle for the material comprising the steps of:

moving the tip of the applicator in a first direction with respect to the receptacle to dispense the material; and moving the tip of the applicator in a second direction with respect to the receptacle to dispense the material.

7. The method of claim 6 in which the first moving step comprises the steps of:

engaging a second set of teeth at one end of the tip with a set of teeth on a moveable platform, the moveable platform positioned at least partially within the receptacle, such that the engaging causes the moveable platform to move with respect to the receptacle.

8. The method of claim 7 in which the second moving step comprises the steps of:

engaging a first set of teeth at one end of the tip with a set of teeth on the receptacle, such that the engaging causes the receptacle to move with respect to the moveable platform.

9. The method of claim 7 wherein:

the moveable platform comprises a wheel having a portion having threads which extend away from the tip and into the receptacle; and a plunger nut positioned within the receptacle has complementary threads to the threads of the wheel, such that rotation of the threads causes the plunger nut to move toward the tip and thereby cause material in the receptacle to move toward the tip.

10. The method of claim 9 wherein:

the plunger nut has an alignment slot which engages an alignment rib in the receptacle, such that rotation of the receptacle causes the plunger nut to move toward the tip and thereby cause material in the receptacle to move toward the tip.

* * * * *